US006874990B2

(12) United States Patent
Nadeau

(10) Patent No.: US 6,874,990 B2
(45) Date of Patent: Apr. 5, 2005

(54) INTEGRAL TIP SEAL IN A FAN-SHROUD STRUCTURE

(75) Inventor: Sylvain Nadeau, London (CA)

(73) Assignee: Siemens VDO Automotive Inc., Mississauga (CA)

( * ) Notice: Subject to any disclaimer, the term of this patent is extended or adjusted under 35 U.S.C. 154(b) by 0 days.

(21) Appl. No.: 10/361,721

(22) Filed: Feb. 10, 2003

(65) Prior Publication Data

US 2004/0156712 A1 Aug. 12, 2004

Related U.S. Application Data

(60) Provisional application No. 60/443,334, filed on Jan. 29, 2003.

(51) Int. Cl.[7] ..... F04D 29/08

(52) U.S. Cl. ..... 415/173.5; 415/173.6; 415/208.1; 415/211.2; 416/192; 123/41.49

(58) Field of Search ..... 415/173.5, 173.6, 415/173.1, 220, 222, 223, 208.1, 211.1, 211.2, 173.4, 186, 208.5; 416/189, 192, 169 A; 123/41.49; 277/411, 412, 414

(56) References Cited

U.S. PATENT DOCUMENTS 3,680,977 A * 8/1972 Rabouyt et al. ..... 415/173.6
3,814,538 A * 6/1974 Sjoqvist ..... 415/220
3,842,902 A * 10/1974 Poslusny ..... 415/173.6
3,858,644 A * 1/1975 Beck et al. ..... 415/222
4,311,431 A * 1/1982 Barbeau ..... 415/173.6
4,548,548 A * 10/1985 Gray, III ..... 416/189
5,297,931 A 3/1994 Yapp et al.
5,489,186 A 2/1996 Yapp et al.
5,957,661 A * 9/1999 Hunt et al. ..... 416/192
6,027,307 A 2/2000 Cho et al.
6,113,347 A * 9/2000 Forrester ..... 415/173.4
6,406,258 B1 * 6/2002 Lin et al. ..... 415/208.5
6,471,472 B1 * 10/2002 Stauder et al. ..... 415/173.4
6,508,624 B2 * 1/2003 Nadeau et al. ..... 415/173.3
6,579,063 B2 * 6/2003 Stairs et al. ..... 416/169 A
2003/0161728 A1 * 8/2003 Cho et al. ..... 415/222

FOREIGN PATENT DOCUMENTS

JP 59-168300 A * 9/1984 ..... 415/173.5

* cited by examiner

*Primary Examiner*—Christopher Verdier

(57) ABSTRACT

A fan-shroud structure 10 includes a fan 12 mounted for rotation about an axis B. The fan has a plurality of blades 20 with tips of the blades being coupled to an annular band 22. A shroud 26, including an annular labyrinth seal 28, is disposed generally adjacent to the annular band thereby defining a gap 30 between the annular band and the seal. The seal has a corrugated profile and is constructed and arranged to provide resistance to air flow as air swirls and flows back into the gap and to minimize air leakage across the gap.

14 Claims, 2 Drawing Sheets

INTEGRAL TIP SEAL IN A FAN-SHROUD STRUCTURE

This application is based on U.S. Provisional Application No. 60/443,334 filed on Jan. 29, 2003 and claims the benefit thereof for priority purposes.

FIELD OF THE INVENTION

The invention relates to fan efficiency increase and noise reduction of fans for engine cooling applications. The primary object of the invention is to provide an effective means of reducing noise and increasing the fan efficiency by minimizing air leakage and its swirling component between banded fan blade tips and the shroud.

BACKGROUND OF THE INVENTION

Conventionally, in axial flow fans, tip seals of a labyrinth type have been used to reduce tip air leakage or the flow of air in a gap (on the order of 5 mm) between the shroud and rotor (fan) in an engine cooling fan assembly. Ribs have also been used in an effort to reduce this air leakage. A disadvantage of the labyrinth seal is that this seal is difficult to manufacture and that often the manufacturing tolerances limit the proper design of the seal. Ribs in the tip region only prevent the swirling component of flow from causing turbulence by reentering the fan. However, the ribs do not seal air leakage through the tip gap effectively.

Accordingly, there is a need to provide a labyrinth seal in a fan-shroud structure to decrease the gap between the rotor and shroud and to remove the swirling components of flow in the tip region of a fan so as to reduce noise with marginal losses in static efficiency.

SUMMARY OF THE INVENTION

An object of the present invention is to fulfill the need referred to above. In accordance with the principles of the present invention, this objective is obtained by providing a fan-shroud structure including a fan mounted for rotation about an axis. The fan has a plurality of blades with tips of the blades being coupled to an annular band. A shroud, including an annular labyrinth seal, is disposed generally adjacent to the annular band thereby defining a gap between the annular band and the seal. The seal has a corrugated profile and is constructed and arranged to provide resistance to air flow as air swirls and flows back into the gap and to minimize air leakage across the gap.

In accordance with another aspect of the invention, a method for providing a labyrinth seal in a shroud of a fan-shroud structure includes steps of: molding a shroud to have a motor mount structure disposed about an axis, and ribs disposed in spaced relation and extending radially with respect to the axis, each rib having one end coupled to the motor mount structure and another end coupled to an annular ring, and molding, integrally with the shroud, an annular labyrinth seal of corrugated profile, the seal being concentric with the annular ring and being axially spaced from and generally adjacent to the annular ring.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
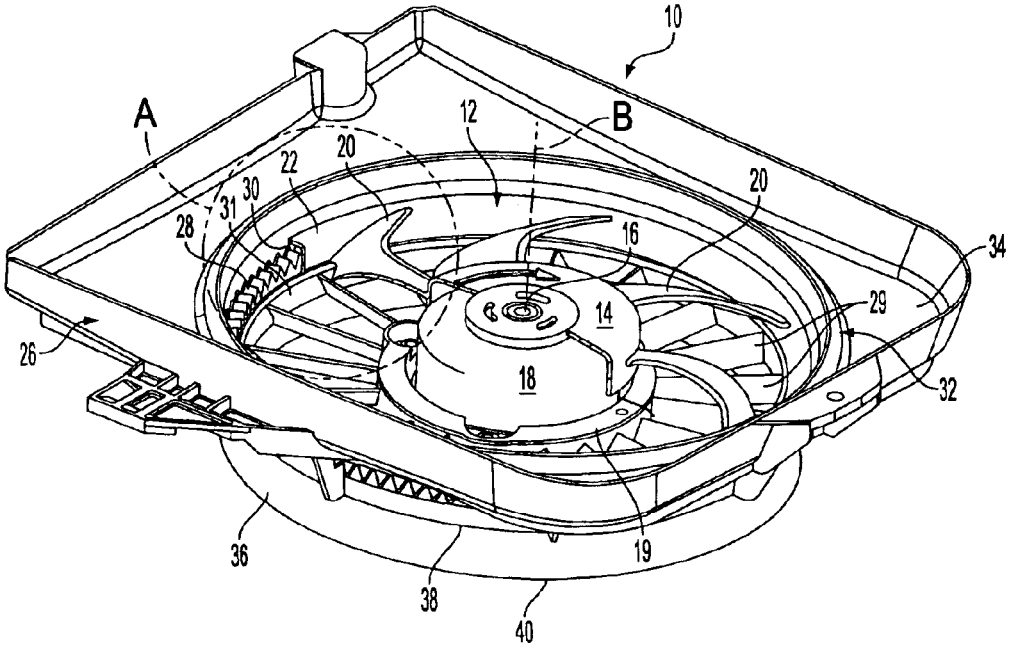
FIG. 1 is a front perspective view of a fan-shroud structure, shown partially cut-away to reveal a labyrinth seal, provided in accordance with the principles of the present invention.
Figure 2:
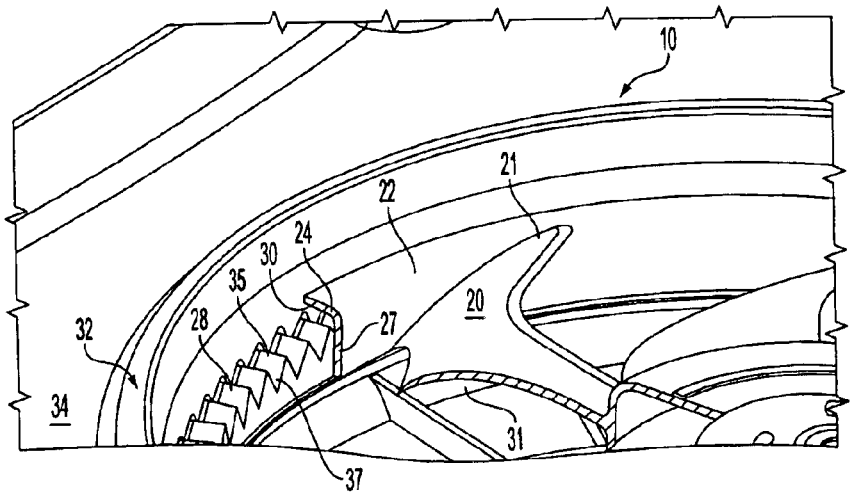
FIG. 2 is an enlarged view of the encircled portion A of FIG. 1.

A fan-shroud structure, generally indicated at 10, is shown in FIG. 1 in accordance with the principles of the invention. The fan-shroud structure 10 includes a fan, generally indicated at 12, having a hub 14 coupled with a shaft 16 of a motor 18 for rotation of the fan 12 about axis B. The fan includes a plurality of blades 20. Each blade 20 is coupled to the hub 14 at one end thereof and the tip 21 of each blade 20 is coupled to an annular band 22. As best shown in FIG. 2, the band 22 is preferably L-shaped, having a radially extending portion 24 and an axially extending portion 27. The motor 18 is mounted to a shroud, generally indicated at 26. The shroud 26 includes support ribs 29 that extend from body 34 of the shroud 26 to a motor mount portion 19 of the shroud. The ribs 29 are generally adjacent to the blades 20 of the fan 12.

Figure 3A:
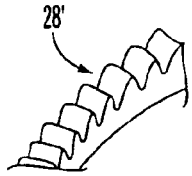
FIGS. 3*a* and 3*b* show various embodiments of the corrugated profile of the labyrinth seal of the invention.
Figure 3B:
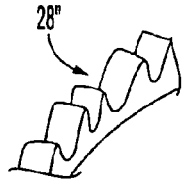

In accordance with the invention, the shroud 26 includes an improved labyrinth seal 28 having a corrugated profile. The seal 28 is preferably molded as an integral part of the shroud 26. Alternatively, the seal 28 can be molded as a separate part and assembled with the shroud 26 in a second operation. The corrugated profile of seal 28 can be of V-shape or polygonal shape with constant or variable spacing. In the embodiment of FIG. 2, the V-shaped profile is saw-toothed, including alternating peaks 35 and valleys 37. The peaks 35 are evenly spaced and the valleys 37 are also evenly spaced. As shown in FIG. 3*a*, seal 28' shows that certain or all peaks or valleys can include a radius without departing from the principles of the invention. FIG. 3*b* shows an uneven spacing of the polygonal shaped seal 28". The seal 28 is annular and generally adjacent to the band 22 to define a gap 30 (FIG. 2) between the seal 28 and the band 22. The seal 28 thus provides resistance to air flow as air swirls and flows back into a gap 30, and minimizes air leakage across the gap 30. The swirl and axial components of air velocity now have to travel past the corrugations that dissipate the kinetic energy of the re-circulating air flow, thus reducing fan noise and increasing efficiency. The structure of the seal 28 also minimizes the size of the gap 30 and increases the air resistance in the gap 30 to minimize axial leakage flow.

As shown in FIGS. 1 and 2, the shroud 26 includes an inlet nozzle, generally indicated at 32. The inlet nozzle 32 is preferably molded as an integral part of the shroud 26 and is embossed and surrounds the band 22 and the seal 28 at a front portion of the shroud 26. Thus, the inlet nozzle 32 has an inner diameter greater than an outer diameter of the annular band 22 and extends upwardly from base 34 of the shroud 26. The inlet nozzle 32 can be molded as an integral part together with the corrugated seal 28 and the shroud 26. The inlet nozzle 32 also significantly increases the stiffness of the shroud 26.

Figure 4:
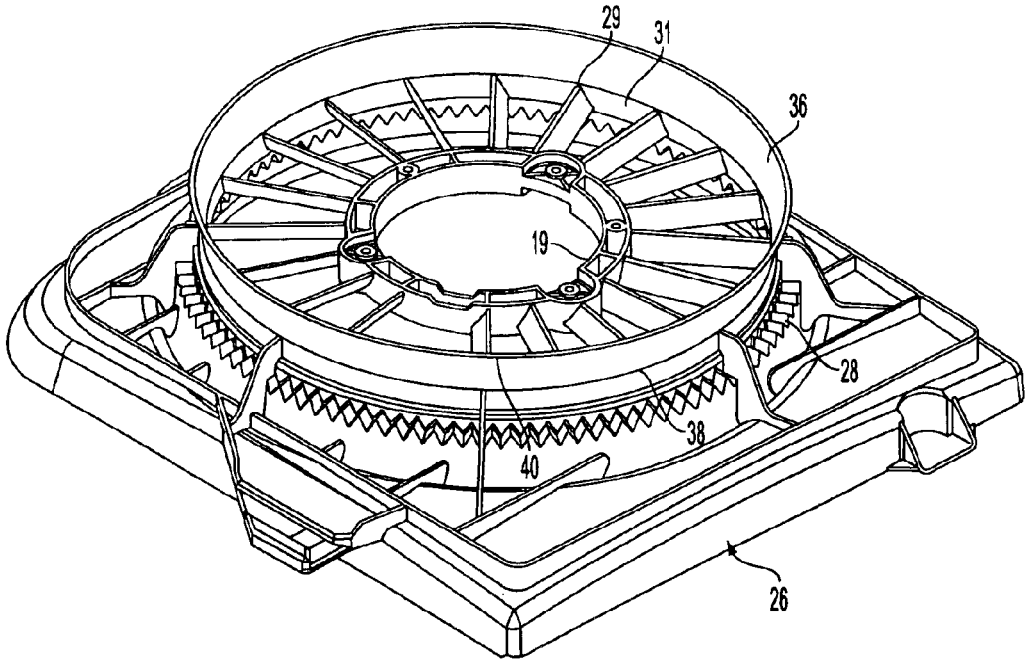
FIG. 4 is a rear view of a shroud of the fan-shroud structure of the invention, showing an outlet diffuser of the shroud.

As shown in FIG. 4 (a rear view of the shroud 26) the shroud 26 includes an outlet diffuser 36 that is preferably molded as a single piece with the shroud 26, the inlet 32 and the seal 28 by using moving slides in a mold. Alternatively, the outlet diffuser can be molded separately and assembled on the shroud in a second operation. The outlet diffuser 36 is thus a generally annular member generally adjacent to the band 22 and seal 28 and extends outwardly from a rear portion of the shroud 26. Since the outlet diffuser 36 functions to diffuse air, a diameter of the diffuser 38 near the ribs 29 is less than the outermost diameter 40.

In accordance with an embodiment of a method of the invention, the labyrinth seal 28 is provided by molding the shroud 26 to have the motor mount structure 19 disposed about an axis B, with the ribs 29 disposed in spaced relation and extending radially with respect to the axis. Each rib 29 has one end coupled to the motor mount structure and another end coupled to an annular ring 31. The labyrinth seal 28 of corrugated profile is molded integrally with the shroud 26 to be concentric with the annular ring 31 and to be axially spaced from and generally adjacent to the annular ring 31. The inlet nozzle 32 is molded, integrally with the one side of the shroud 26. The inlet nozzle 32 is concentric with the annular ring 31 and is axially spaced from the seal 28. The outlet diffuser 36 is molded, integrally with a side of the shroud opposite the one side thereof. The outlet diffuser 32 is concentric with and axially spaced from the annular ring 31.

Thus, since the seal 28 is molded integrally with the shroud, difficulty in manufacturing of the seal is reduced and tolerances can be controlled more easily.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fan-shroud structure comprising:

a fan mounted for rotation about an axis, the fan having a plurality of blades, tips of the blades being coupled to an annular band, and a shroud including an annular labyrinth seal disposed generally adjacent to the annular band thereby defining a gap between the annular band and the seal, the seal having a corrugated profile and being constructed and arranged to provide resistance to air flow as air swirls and flows back into the gap and to minimize air leakage across the gap, wherein the corrugated profile of the labyrinth seal is generally V-shaped having alternating, continuously joined, peaks and valleys.

2. The fan-shroud structure of claim 1, wherein the peaks are evenly spaced and the valleys are evenly spaced.

3. The fan-shroud structure of claim 1, wherein the corrugated profile is of polygonal shape.

4. The fan-shroud structure of claim 1, wherein each of the peaks and valleys includes a radius portion.

5. The fan-shroud structure of claim 1, wherein the alternating peaks and valleys are evenly spaced.

6. The fan-shroud structure of claim 1, wherein the alternating peaks and valleys are unevenly spaced.

7. The fan-shroud structure of claim 1, wherein the labyrinth seal is formed integrally with the shroud.

8. The fan-shroud structure of claim 1, wherein the shroud includes an annular inlet nozzle surrounding the band and seal and extending outwardly at a front portion of the shroud.

9. The fan-shroud structure of claim 8, wherein the inlet nozzle is formed integrally with the shroud and has an inner diameter greater than an outer diameter of the annular band.

10. The fan-shroud structure of claim 1, wherein the shroud includes an outlet diffuser generally adjacent to the band and seal and extending outwardly at a rear portion of the shroud.

11. The fan-shroud structure of claim 10, wherein the outlet diffuser is formed integrally with the shroud.

12. The fan-shroud structure of claim 1, wherein the shroud includes an annular inlet nozzle surrounding the band and seal and extending outwardly at a front portion of the shroud and the shroud includes an outlet diffuser generally adjacent to the band and seal and extending outwardly at a rear portion of the shroud.

13. The fan-shroud structure of claim 12, wherein the inlet nozzle and the outlet diffuser are formed integrally with the shroud.

14. The fan-shroud structure of claim 1, wherein the band is generally L-shaped in section defining a radially extending portion and a portion extending in the direction of the axis of the fan, and wherein the peaks extend towards the radially extending portion.

* * * * *